US009087435B2

(12) United States Patent
Herrmann

(10) Patent No.: US 9,087,435 B2
(45) Date of Patent: Jul. 21, 2015

(54) SYSTEM AND METHOD FOR CONDUCTING GAMES OF SKILL AND/OR CHANCE FOR ON-PROPERTY AND OFF-PROPERTY PLAYERS

(75) Inventor: Mark E. Herrmann, Wellesley, MA (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 570 days.

(21) Appl. No.: 12/847,191

(22) Filed: Jul. 30, 2010

(65) Prior Publication Data

US 2011/0081971 A1 Apr. 7, 2011

Related U.S. Application Data

(60) Provisional application No. 61/230,195, filed on Jul. 31, 2009.

(51) Int. Cl.
*A63F 9/24* (2006.01)
*G07F 17/32* (2006.01)

(52) U.S. Cl.
CPC ..... *G07F 17/3272* (2013.01); *G07F 17/32* (2013.01); *G07F 17/3293* (2013.01)

(58) Field of Classification Search
CPC ..... G07F 17/3267; G07F 17/3276; G07F 17/3262; G07F 17/3272; G07F 17/3295; G07F 17/3288; A63F 13/12; A63F 2300/50; A63F 3/00157
USPC ..... 463/16–20, 42, 43
See application file for complete search history.

(56) References Cited

U.S. PATENT DOCUMENTS

| | | | | |
|---|---|---|---|---|
| 6,508,709 | B1 * | 1/2003 | Karmarkar | 463/42 |
| 2005/0159212 | A1 * | 7/2005 | Romney et al. | 463/25 |
| 2005/0250567 | A1 | 11/2005 | Kane et al. | |
| 2006/0073882 | A1 * | 4/2006 | Rozkin et al. | 463/25 |
| 2006/0154714 | A1 * | 7/2006 | Montross et al. | 463/13 |
| 2006/0178187 | A1 * | 8/2006 | Walker et al. | 463/16 |
| 2006/0211471 | A1 * | 9/2006 | Walker et al. | 463/16 |
| 2006/0247064 | A1 * | 11/2006 | Nguyen et al. | 463/43 |
| 2008/0132311 | A1 * | 6/2008 | Walker | 463/16 |
| 2008/0146322 | A1 | 6/2008 | Hardy et al. | |

* cited by examiner

*Primary Examiner* — Steve Rowland
(74) *Attorney, Agent, or Firm* — Dority & Manning, P.A.

(57) ABSTRACT

In one aspect, a multiplayer game format is provided that permits both off-property and on-property players to participate in a multiplayer game that provides awards to a winning player. Such a game format may include rake games which maximize the income of such types of games.

19 Claims, 5 Drawing Sheets

SYSTEM AND METHOD FOR CONDUCTING GAMES OF SKILL AND/OR CHANCE FOR ON-PROPERTY AND OFF-PROPERTY PLAYERS

RELATED APPLICATION

This application claims priority under 35 U.S.C. §119(e) to U.S. Provisional Application No. 61/230,195, entitled "SYSTEM AND METHOD FOR CONDUCTING GAMES OF SKILL AND/OR CHANCE FOR ON-PROPERTY AND OFF-PROPERTY PLAYERS," filed Jul. 31, 2009, which is hereby incorporated by reference in its entirety.

BACKGROUND OF THE DISCLOSURE

1. Field of the Invention

Aspects of the present invention relate generally to multi-player games of skill and chance.

2. Discussion of Related Art

Traditionally, gaming operators have offered multi-player games of skill and chance to their patrons. The gaming operator usually takes a commission for organizing, staffing and hosting the game (whether the game is bingo, poker or some other game). This commission is typically referred to as the "rake." The rake is generally 5 to 25 percent of the pot, up to a predetermined maximum amount. However, the rake percentage can be any amount or determined in other ways, as there are other non-percentage ways for a casino to take the rake.

Gaming operators have continually looked for ways to make their gaming operations more efficient. Most recently, they have begun to install electronic tables (e.g., poker tables, bingo terminals etc.) to alleviate the need for staff while increasing the speed of play. By reducing the cost and increasing the rate of play, the gaming operator makes the entire gaming process more efficient and therefore, more profitable.

SUMMARY

According to one aspect of the present invention, a system and method is provided for linking, via a network, on-property qualified players and off property qualified players in multi-player games of skill and chance. According to one embodiment, the off property player could be a member of the gaming operator's player club (e.g., a qualified player) and the issue of age validation is easily solved. Otherwise, the age of the player may be verified using other methods (e.g., at the property prior to play). Additionally, the player could stake the account at the casino thus eliminating the need for electronic fund transfers. It should be appreciated that there are many ways to implement such a system that would permit a player to legally participate with other players in multiplayer games being conducted at the gaming location.

Creating a networked effect between off-property players and on-property players (and, according to another embodiment, between players from different gaming operators and locations) could magnify the financial returns for gaming operators as players would likely have multiple tables (either physical or virtual to play at) which, in turn, generates more revenue through a static number of physical rake games. By providing off-property access to games, the revenue for each game being conducted on-property is maximized. Further, it provides a benefit to the players (both on-property and off-property), as the more players in a rake game, the higher the amount of money that could potentially be won by the player. Also, by providing an off-property gaming option, the off-property player will be provided additional opportunities to win, and will permit the gaming experience to be extended to the off-property location. Further, the off-property player will be permitted to play the same type of game offered within the on-property environment, continuing and enhancing the interest of the player.

As an example, poker is a great game but it is often difficult to fill a poker room located at a site of a gaming operator. It is appreciated that too many players want to play at peak times and too few players play at off peak times. Thus, it is appreciated that it would be a benefit to link off-property players with on-property games.

In the case of poker (e.g., a game of Texas Hold'em) which has some skill elements, there can be generated a number of card scenarios for the off-property player, such that it is ensured that the off-property player receives a predetermined outcome. In one embodiment, a number of predetermined outcomes are pre-generated prior to the game, and when an off-property player requests for one of those outcomes, the predetermined outcomes are used to drive the off-property gaming experience. In the case of a poker game, a number of card outcomes could be pre-generated and selected at game time to fit the actual game scenario. For the on-property players that are participating in the same game session, they may play normally (e.g., with elements of skill and chance) and their participation may be conducted in a normal way.

In another game example, on-property and off-property players play a multiplayer game involving a grid of squares (e.g., 10,000 squares). The players move along the grid in different directions (e.g., horizontally, vertically, diagonally) according to a randomized function (e.g., a roll of a die). The players may move in the grid until they fall of the grid and are eliminated from the game, or they become eliminated by "battling" each other. For instance, when they move adjacent to another player in the grid, another randomized event (e.g., another roll of a die) determines who remains in the grid. The last player (or group of players) standing may win a pot, with 10% or other amount of the pot going to the game operator as the rake.

For on-property players, such randomized functions may be performed in real-time, but in the case of the off-property player, their movements may be pre-generated prior to game play and just played out during play of the multiplayer game. In such a case, the off-property player cannot affect the outcome of the multiplayer game. In one game format example, the off-property player may purchase a ticket on-property that corresponds to a number of predetermined dice roll outcomes, and when the game is played off-property, those outcomes are revealed to the player.

To avoid issues with accepting funds and transferring them while the player is off-property, the player may pre-pay for certain game entries at the gaming location. For instance, the player may pay $100 for 10 entries to be played in an off-property location. In one example, when the player accesses an Internet site hosting the game interface, that player is permitted to enter information identifying the entries (e.g., a ticket number) or other identifier (e.g., a frequent player card associated with the entries) to permit the off-property player to access the game. Any winnings may be credited to an account after game play, or the player may redeem the winning play when he/she returns to the gaming location.

In one aspect of the present invention, a method for conducting a multiplayer game is featured. The method comprises acts of generating, by a gaming system, a plurality of predetermined outcomes, permitting an entry of both an on-property player and an off-property player into a multiplayer game session conducted at an on-property gaming location, assigning at least one of the plurality of predetermined outcomes to the off-property player, conducting the multiplayer game, and during play of the multiplayer game, revealing an outcome to the off-property player corresponding to the at least one of the plurality of predetermined outcomes.

According to one embodiment, the method may further comprise an act of determining an outcome associated with the on-property player based on at least one of a randomized, a predetermined, and a skill-based event. According to another embodiment, the method may further comprise an act of presenting the outcome associated with the on-property player to the on-property player. According to one embodiment, the act of revealing an outcome to the off-property player includes presenting the outcome to the off-property player as a random event.

According to one embodiment, the method may further comprise an act of associating the entry of the off-property player with a frequent player identifier. According to another embodiment, the method may further comprise an act of issuing a ticket associated with the entry of the off-property player, the ticket including access information that permits the off-property player to access the multiplayer game session. According to one embodiment, the multiplayer game is a rake-style game.

In another aspect of the present invention, a distributed system for conducting a multiplayer game is provided. The system may comprise at least one electronic game system located at an on-property gaming location, at least one computing device located at an off-property location, an on-property network coupled to the at least one electronic game, and an off-property network coupled to the at least one computing device and configured to communicate with the on-property network, wherein the at least one electronic game system is configured to permit entry of an on-property player to the multiplayer game, permit entry of an off-property player to the multiplayer game via the at least one computing device, and conduct the multiplayer game.

According to one embodiment, the at least one electronic game system is further configured to generate a plurality of predetermined outcomes, assign at least one of the plurality of predetermined outcome to the off-property player, and reveal an outcome to the off-property player corresponding to the at least one of the plurality of predetermined outcomes.

According to another embodiment, the at least one electronic game system includes at least one Electronic Gaming Machine (EGM). In one embodiment, the at least one electronic game system includes at least one electronic table game.

According to one embodiment, the at least one computing device includes at least one personal computer. In another embodiment, the at least one computing device includes at least one mobile computing device.

According to one embodiment, the multiplayer game is a rake-style game. According to another embodiment, the off-property network is configured to communicate with the on-property network via the Internet.

In one aspect of the present invention, a computer readable medium is featured. The computer readable medium comprises computer-executable instructions that when executed on a processor performs a method for conducting a promotional game, the method comprising acts of generating, by a gaming system, a plurality of predetermined outcomes, permitting an entry of both an on-property player and an off-property player into a multiplayer game session conducted at an on-property gaming location, assigning at least one of the plurality of predetermined outcomes to the off-property player, conducting the multiplayer game, and during play of the multiplayer game, revealing an outcome to the off-property player corresponding to the at least one of the plurality of predetermined outcomes.

According to one embodiment, the method may further comprise an act of determining an outcome associated with the on-property player based on at least one of a randomized, a predetermined, and a skill-based event. According to another embodiment, the method may further comprise an act of presenting the outcome associated with the on-property player to the on-property player. According to one embodiment, the act of revealing an outcome to the off-property player includes presenting the outcome to the off-property player as a random event.

According to another embodiment, the method may further comprise an act of issuing a ticket associated with the entry, the ticket including access information that permits the off-property player to access the multiplayer game session. In one embodiment, the multiplayer game is a rake-style game.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION OF THE PREFERRED EMBODIMENTS

It is appreciated that another problem with rake games is that the games themselves take up a lot of space within the gaming establishment. Operators would prefer to fill the space with electronic gaming machines (EGMs) during off peak times (e.g., when players are not playing rake games) but this has proved to be impractical. A solution to this problem, according to one aspect of the present invention, includes allowing players while they are at an off-property location (e.g., at home, at a mobile computing location, etc.) to participate in these games via a networked system. This way, the gaming operator would stand a better chance of using the allotted space to produce the maximum revenue.

Figure 1:
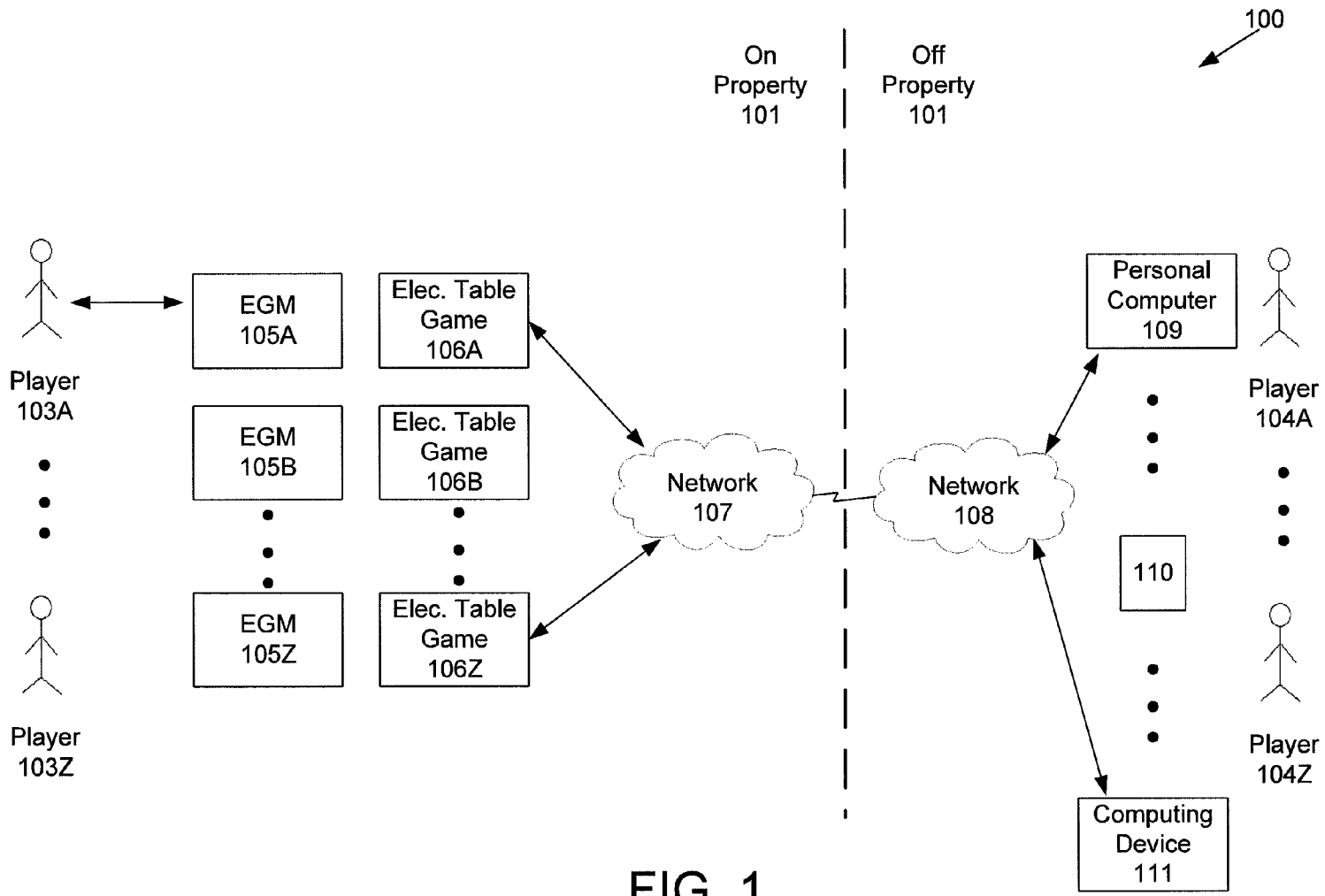
FIG. 1 is a block diagram of a distributed network used to conduct a multiplayer game in accordance with one embodiment of the present invention.

FIG. 1 shows one embodiment of a distributed network 100 used to conduct a multiplayer game according to various embodiments of the present invention. In particular, network 100 includes a number of systems, including ones located on property 101 that are connected to an on-property network 107. Similarly, there may be one or more systems located off-property 102 coupled to an off-property communication network 108.

There may be one or more players (e.g., players 103A-103Z) located at the on-property location (e.g., in a casino)

that are capable of playing one or more on-property games. They may play using one or more electronic gaming machines (EGMs, for instance EGMs 105A-105Z), electronic table games (e.g., games 106A-106Z), or other game types that are coupled to network 107. Such systems may offer one or more games within the on-property gaming environment. Such games may be multiplayer games.

According to one aspect, access to such games is also provided to players located off-property. For instance, there may be one or more off-property players (e.g., players 104A-104Z) that are provided the ability to join a multiplayer game having one or more on-property game participants (e.g., players 103A-103Z). Such off-property players may access such games using any type of method, such as a personal computer (e.g., computer 109), mobile computing devices (e.g., device 110) such as a personal digital assistant (PDA), cell phone, or other network-enabled device (e.g., an iTouch device), or any other computing device 111 capable of communicating with network 108.

Figure 2:
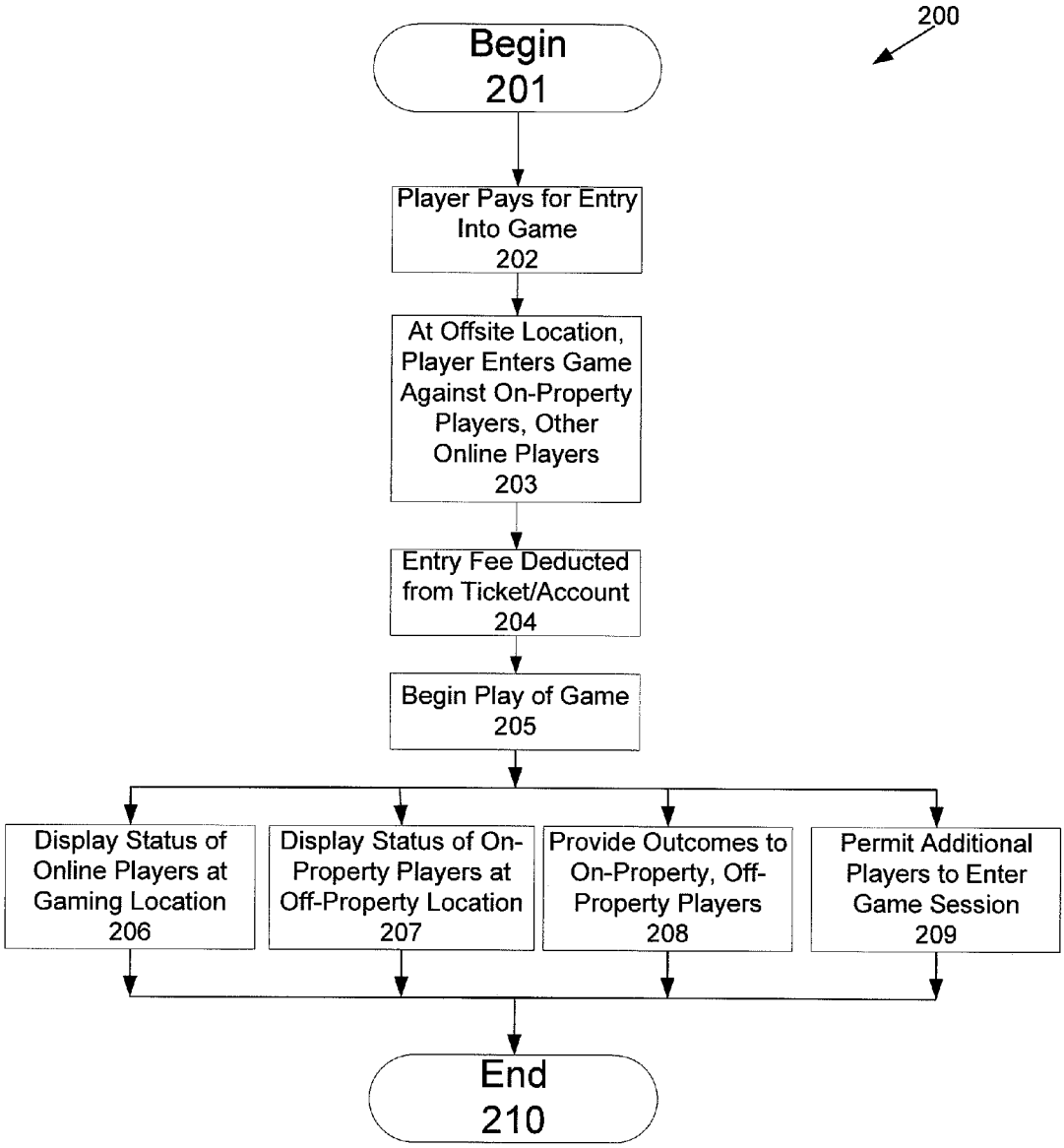
FIG. 2 illustrates a process for conducting a multiplayer game in accordance with one embodiment of the present invention.

FIG. 2 shows a process for conducting a multiplayer game according to various aspects of the present invention. At block 201, process 200 begins. At block 202, a player pays for entry into the multiplayer game. As discussed above, payment may be accepted on-property, such as at a casino location. Alternatively, entry into the game may be provided by the game operator for free, such as in the case of a promotional entry used to encourage the player to engage the casino or other gaming location. It should be appreciated that the game operator may provide any number of entries into the game session, with any number of participants having paid, free, on-property or off-property entries.

At block 203, at an off-property location, a player enters a game participating against one or more on-property and off-property players. If the entry is a paid entry, an entry fee may be deducted from a purchased ticket, prepaid account or other legal payment method (at block 204). At block 205, play of the game is conducted (e.g., using one or more systems in distributed network 100).

As discussed, for online, off-property players, one or more predetermined outcomes may be used to drive that particular player's outcome. Also, for on-property players, their outcomes may be generated in any number of ways, such as by random, pseudo-random methods, using skill elements, predetermined outcomes, or any combination of methods. At block 208, one or more systems (e.g., in distributed network 100) may provide such outcomes to on-property and off-property players within a multiplayer gaming session.

Further, the game may provide other functions, such as permitting additional players to enter the game session (block 209), displaying the status of the off-property, online players within the particular game session at the gaming location (block 206), or vice versa (block 207). Notably, the indication of additional players that are participating in the multiplayer game at either location may encourage participation, as the number of participating players may increase the amount of money that could be won. At block 210, the multiplayer game ends.

Figure 3:
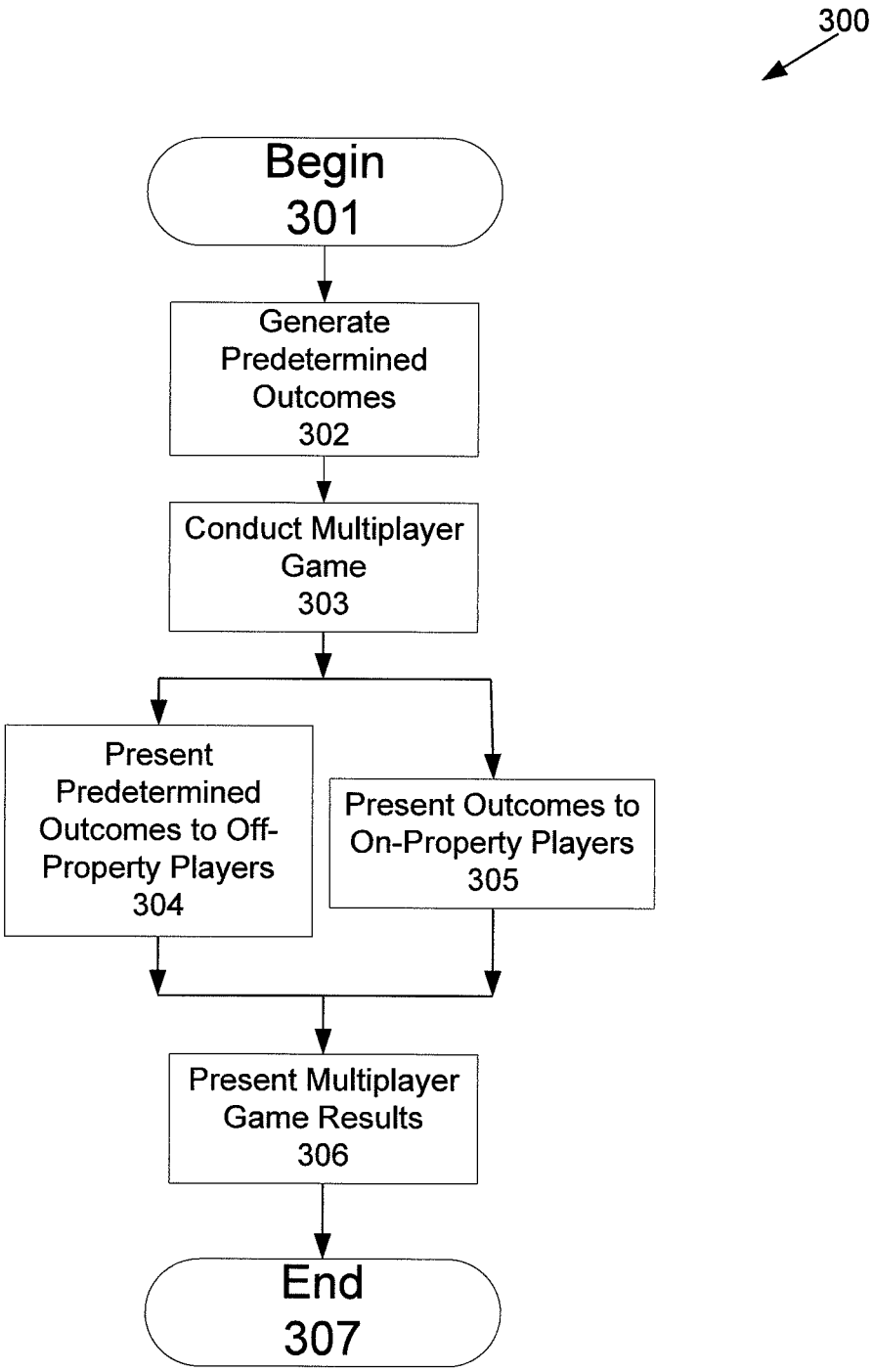
FIG. 3 illustrates another process for conducting a multiplayer game in accordance with one embodiment of the present invention.

FIG. 3 shows another process 300 of conducting a multiplayer game according to various aspects of the present invention. At block 301, process 300 begins. At block 302, one or more predetermined outcomes are generated (e.g., by a game playing system, EGM, electronic table game, or other system). These predetermined outcomes are provided to a player (for instance, as associated with a ticket purchased at a gaming location) before or during game play (e.g., as another predetermined outcome is needed). At block 303, a game playing system conducts the multiplayer game including both on-property and off-property players.

At block 304, one or more predetermined outcomes are presented to off-property players. These outcomes may be presented to the off-property player as a random event, such as a deal of a card, roll of a die, spin of a wheel or other game event. Similarly, within the multiplayer game, on-property players are presented their outcomes (e.g., at block 305) which could be determined in any manner. At the end of the multiplayer game, the system may present any results of the multiplayer game to both types of players (e.g., at block 306), and any winnings could be provided to the winning player(s) at that point. As previously discussed, off-property players may be required to return to the gaming location to redeem their winnings.

Alternatively, existing systems may be modified to provide such a game format. For instance, various systems may be used that are described in U.S. patent application Ser. No. 11/840,541, entitled "METHOD AND APPARATUS FOR PROVIDING PLAYER INCENTIVES" filed Aug. 17, 2007, which is incorporated by reference herein in its entirety.

Various embodiments according to the present invention may be implemented on one or more computer systems, such as a personal computer (PC), cell phone or other personal computing device capable of linking, via one or more networks, qualified players in multi-player games. Other aspects of the present invention may be performed on other computer systems, including, but not limited to, game systems, databases, Electronic Gaming Machines (EGMs) or other computerized casino-based systems, lottery systems or other systems related to game play.

A computer system may be a single computer that may include a minicomputer, a mainframe, a personal computer, or combination thereof. The computer system may include any type of system capable of performing remote computing operations (e.g., cell phone, PDA, set-top box, or other system). A computer system used to run the operation may also include any combination of computer system types that cooperate to accomplish system-level tasks. Multiple computer systems may also be used to run the operation. The computer system also may include input or output devices, displays, or storage units. It should be appreciated that any computer system or systems may be used, and the invention is not limited to any number, type, or configuration of computer systems.

These computer systems may be, for example, general-purpose computers such as those based on Intel PENTIUM-type processor, Motorola PowerPC, Sun UltraSPARC, Hewlett-Packard PA-RISC processors, or any other type of processor. It should be appreciated that one or more of any type computer system may be used to partially or fully automate play of the described game according to various embodiments of the invention. Further, the software design system may be located on a single computer or may be distributed among a plurality of computers attached by a communications network.

Figure 4:
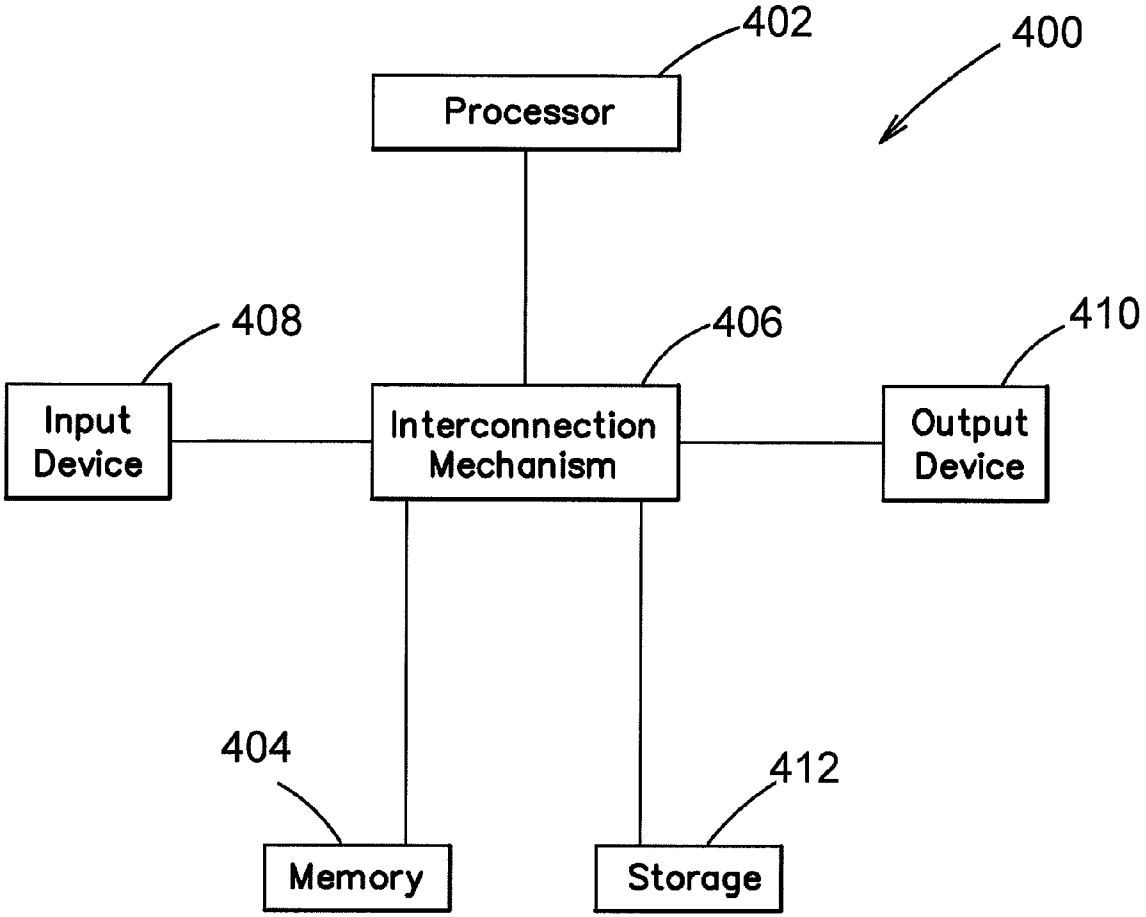
FIG. 4 is a block diagram of a general-purpose computer system upon which various embodiments of the invention may be implemented.
Figure 5:
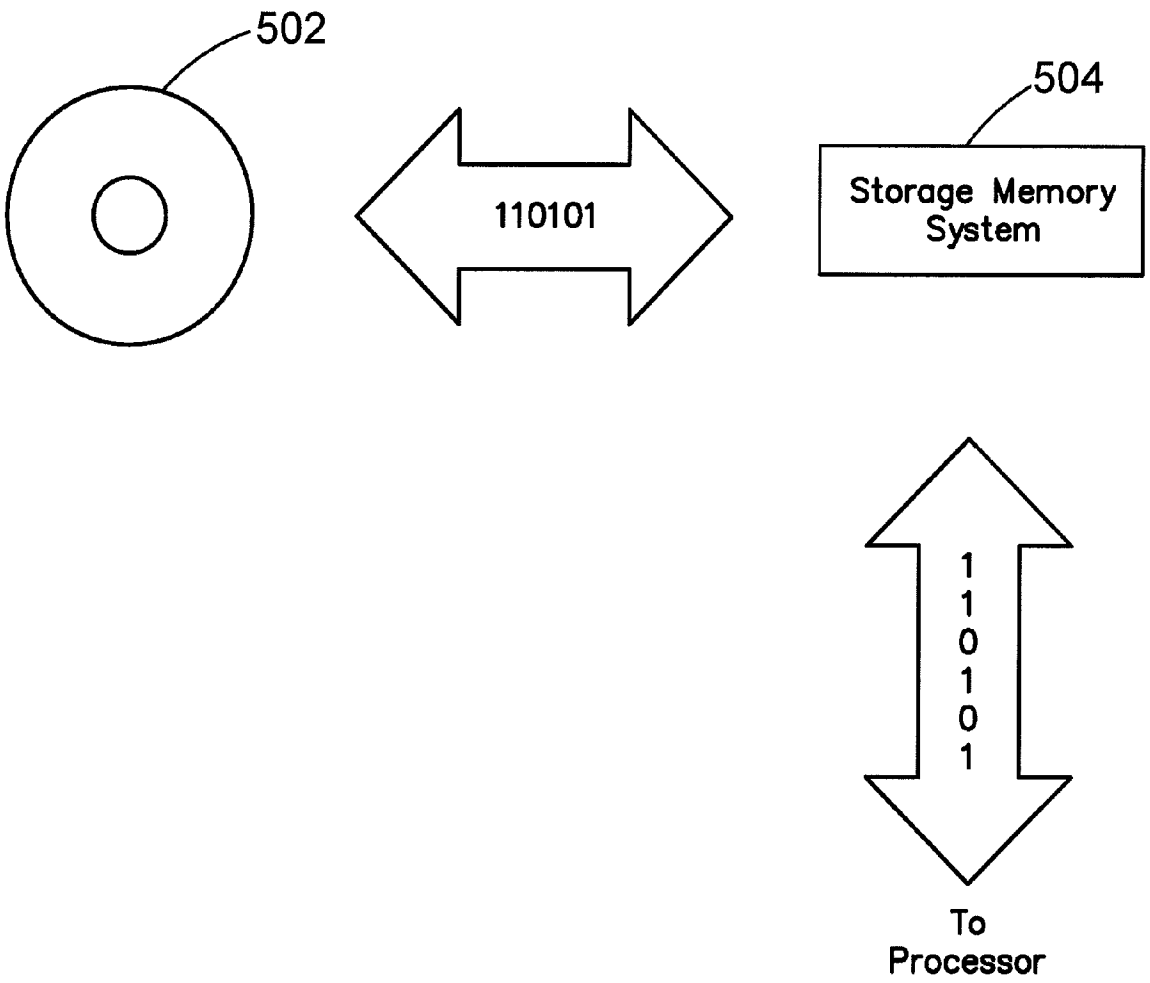
FIG. 5 is a block diagram of a computer data storage system with which various embodiments of the invention may be practiced.

For example, various aspects of the invention may be implemented as specialized software executing in a general-purpose computer system 400 such as that shown in FIG. 4. The computer system 400 may include a processor 402 connected to one or more memory devices 404, such as a disk drive, memory, or other device for storing data. Memory 404 is typically used for storing programs and data during operation of the computer system 400. Components of computer system 400 may be coupled by an interconnection mechanism 406, which may include one or more busses (e.g., between components that are integrated within a same machine) and/or a network (e.g., between components that reside on separate discrete machines). The interconnection mechanism 406 enables communications (e.g., data, instructions) to be exchanged between system components of system 400. Computer system 400 also includes one or more input devices 408, for example, a keyboard, mouse, trackball, microphone, touch screen, and one or more output devices 410, for example, a printing device, display screen, and/or speaker. In addition, computer system 400 may contain one or more interfaces (not shown) that connect computer system 400 to a communication network (in addition or as an alternative to the interconnection mechanism 406.

The storage system 412, shown in greater detail in FIG. 500, typically includes a computer readable and writeable nonvolatile recording medium 502 in which signals are stored that define a program to be executed by the processor or information stored on or in the medium 502 to be processed by the program. The medium may, for example, be a disk or flash memory. Typically, in operation, the processor causes data to be read from the nonvolatile recording medium 502 into another memory 504 that allows for faster access to the information by the processor than does the medium 502. This memory 504 is typically a volatile, random access memory such as a dynamic random access memory (DRAM) or static memory (SRAM). It may be located in storage system 412, as shown, or in memory system 404. The processor 402 generally manipulates the data within the integrated circuit memory 404, 504 and then copies the data to the medium 502 after processing is completed. A variety of mechanisms are known for managing data movement between the medium 502 and the integrated circuit memory element 404, 504, and the invention is not limited thereto. The invention is not limited to a particular memory system 404 or storage system 412.

The computer system may include specially-programmed, special-purpose hardware, for example, an application-specific integrated circuit (ASIC). Aspects of the invention may be implemented in software, hardware or firmware, or any combination thereof. Further, such methods, acts, systems, system elements and components thereof may be implemented as part of the computer system described above or as an independent component.

Although computer system 400 is shown by way of example as one type of computer system upon which various aspects of the invention may be practiced, it should be appreciated that aspects of the invention are not limited to being implemented on the computer system as shown in FIG. 4. Various aspects of the invention may be practiced on one or more computers having a different architecture or components that that shown in FIG. 4.

Computer system 400 may be a general-purpose computer system that is programmable using a high-level computer programming language. Computer system 400 may be also implemented using specially programmed, special purpose hardware. In computer system 400, processor 402 is typically a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME), Windows XP, or Windows Visa operating systems available from the Microsoft Corporation, MAC OS System X available from Apple Computer, the Solaris Operating System available from Sun Microsystems, or UNIX available from various sources. Many other operating systems may be used.

The processor and operating system together define a computer platform for which application programs in high-level programming languages are written. It should be understood that the invention is not limited to a particular computer system platform, processor, operating system, or network. Also, it should be apparent to those skilled in the art that the present invention is not limited to a specific programming language or computer system. Further, it should be appreciated that other appropriate programming languages and other appropriate computer systems could also be used.

One or more portions of the computer system may be distributed across one or more computer systems (not shown) coupled to a communications network. These computer systems also may be general-purpose computer systems. For example, various aspects of the invention may be distributed among one or more computer systems configured to provide a service (e.g., servers) to one or more client computers, or to perform an overall task as part of a distributed system. For example, various aspects of the invention may be performed on a client-server system that includes components distributed among one or more server systems that perform various functions according to various embodiments of the invention. These components may be executable, intermediate (e.g., IL) or interpreted (e.g., Java) code which communicate over a communication network (e.g., the Internet) using a communication protocol (e.g., TCP/IP).

According to various embodiments, an Internet-based system may be provided to facilitate various aspects of the present invention. As discussed, various aspects of the invention may be implemented on an Internet-based system, generally involving a website infrastructure. As is known in the art, a basic website infrastructure contains web server(s), application server(s) and database server(s). Servers may be located on the same computer hardware or may be separated onto different computer hardware at various locations depending on processing or security requirements. Networking equipment is also required to connect the servers to the Internet and to interconnect servers when they are implemented on separate computer hardware. As used herein, a "network" or a "communication network" is a group of two or more devices interconnected by one or more segments of transmission media or active communications equipment on which communications may be exchanged between the devices. One example of a network includes the Internet, at least a portion of which may be used to remotely access incentive information.

A web server is used to handle requests and delivery of content from and to the browsers of website visitors. The web server also dispatches requests and data to the application servers.

The application server is used to control the website processes and to supply dynamic content back to the web servers. The application server performs all data dependent procedures at the website.

The database server manages the storage of all data required by the website. It responds to requests (storage and retrieval) for data from the application server. Various embodiments of the present invention may be implemented in a gaming system as described, for example, in U.S. patent application Ser. No. 11/001,775 filed Nov. 30, 2004, entitled "METHOD AND APPARATUS FOR CONDUCTING A GAME OF CHANCE", which is incorporated herein by reference. However, it should be appreciated that other gaming system infrastructures may be used.

It should be appreciated that the invention is not limited to executing on any particular system or group of systems. Also, it should be appreciated that the invention is not limited to any particular distributed architecture, network, or communication protocol. Various embodiments of the present invention may be programmed using an object-oriented programming language, such as SmallTalk, Java, C++, Ada, or C# (C-Sharp). Other object-oriented programming languages may also be used. Alternatively, functional, scripting, and/or logical programming languages may be used. Various aspects of the invention may be implemented in a non-programmed environment (e.g., documents created in HTML, XML or other format that, when viewed in a window of a browser program, render aspects of a graphical-user interface (GUI) or perform other functions). Various aspects of the invention may be implemented as programmed or non-programmed elements, or any combination thereof.

Having thus described several aspects of at least one embodiment of this invention, it is to be appreciated that various alterations, modifications and improvements will readily occur to those skilled in the art. Such alterations, modifications, and improvements are intended to be part of this disclosure, and are intended to be within the spirit and scope of the invention. Accordingly, the foregoing description is by way of example only.

What is claimed is:

1. A method for conducting a multiplayer game comprising acts of:

generating, by a gaming system, a plurality of predetermined outcomes;

requiring, by the gaming system, an entry of both an on-property player and an off-property player into a multiplayer game session conducted at an on-property gaming location, wherein the on-property and off-property players are required to compete against each other in the multiplayer game session conducted at the on-property gaming location such that only one of the on-property player or the off-property player wins the game session;

assigning, by the gaming system, at least one of the plurality of predetermined outcomes to the off-property player, wherein determining if the predetermined outcome is a winning or losing outcome depends upon game play during the multiplayer game session;

conducting the multiplayer game via the gaming system; and during play of the multiplayer game, revealing, by the gaming system, an outcome to the off-property player corresponding to the at least one of the plurality of predetermined outcomes.

2. The method according to claim 1, further comprising an act of determining an outcome associated with the on-property player based on at least one of a randomized, a predetermined, or a skill-based event.

3. The method according to claim 2, further comprising an act of presenting the outcome associated with the on-property player to the on-property player.

4. The method according to claim 1, wherein the act of revealing an outcome to the off-property player includes presenting the outcome to the off-property player as a random event.

5. The method according to claim 1, further comprising an act of associating the entry of the off-property player with a frequent player identifier.

6. The method according to claim 1, further comprising an act of issuing a ticket associated with the entry of the off-property player, the ticket including access information that permits the off-property player to access the multiplayer game session.

7. The method according to claim 1, wherein the multiplayer game is a rake-style game.

8. A distributed system for conducting a multiplayer game, the system comprising:

at least one electronic game system located at an on-property gaming location;

at least one computing device located at an off-property location;

an on-property network coupled to the at least one electronic game; and an off-property network coupled to the at least one computing device and configured to communicate with the on-property network, wherein the at least one electronic game system is configured to;

require entry of an on-property player to the multiplayer game, require entry of an off-property player to the multiplayer game via the at least one computing device, wherein the on-property player and the off-property player are required to compete against each other in the multiplayer game session conducted at the on-property gaming location such that only one of the on-property player or the off-property player wins the game session, conduct the multiplayer game, generate a plurality of predetermined outcomes, assign at least one of the plurality of predetermined outcome to the off-property player, wherein determining if the predetermined outcome is a winning or losing outcome depends upon game play during the multiplayer game session, and reveal an outcome to the off-property player corresponding to the at least one of the plurality of predetermined outcomes.

9. The system of claim 8, wherein the at least one electronic game system includes at least one Electronic Gaming Machine (EGM).

10. The system of claim 8, wherein the at least one electronic game system includes at least one electronic table game.

11. The system of claim 8, wherein the at least one computing device includes at least one personal computer.

12. The system of claim 8, wherein the at least one computing device includes at least one mobile computing device.

13. The system of claim 8, wherein the multiplayer game is a rake-style game.

14. The system of claim 8, wherein the off-property network is configured to communicate with the on-property network via the Internet.

15. A non-transitory computer readable medium comprising computer-executable instructions that when executed on a processor performs a method for conducting a promotional game, the method comprising acts of:

generating, by a gaming system, a plurality of predetermined outcomes;

requiring an entry of both an on-property player and an off-property player into a multiplayer game session conducted at an on-property gaming location, wherein the on-property and off-property players are required to compete against each other in the multiplayer game session conducted at the on-property gaming location such that only one of the on-property player or the off-property player wins the game session;

assigning at least one of the plurality of predetermined outcomes to the off-property player, wherein determining if the predetermined outcome is a winning or losing outcome depends upon game play during the multiplayer game session;

conducting the multiplayer game; and during play of the multiplayer game, revealing an outcome to the off-property player corresponding to the at least one of the plurality of predetermined outcomes.

16. The computer readable medium according to claim 15, wherein the method further comprises an act of determining an outcome associated with the on-property player based on at least one of a randomized, a predetermined, or a skill-based event.

17. The computer readable medium according to claim 16, wherein the method further comprises an act of presenting the outcome associated with the on-property player to the on-property player.

18. The computer readable medium according to claim 15, wherein the act of revealing an outcome to the off-property player includes presenting the outcome to the off-property player as a random event.

19. The computer readable medium according to claim 13, wherein the method further comprises an act of issuing a ticket associated with the entry, the ticket including access information that permits the off-property player to access the multiplayer game session.

* * * * *